US012612561B2

(12) United States Patent
Laurent et al.

(10) Patent No.: US 12,612,561 B2
(45) Date of Patent: Apr. 28, 2026

(54) DIRECT STEAM CRACKING METHODS FOR LIQUIDS PRODUCED FROM PLASTIC WASTE

(71) Applicant: ExxonMobil Chemical Patents Inc., Baytown, TX (US)

(72) Inventors: Philippe Laurent, Houston, TX (US); Jennifer L Rougeau, Houston, TX (US); Beshoy G. Abdelmalek, Seabrook, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 439 days.

(21) Appl. No.: 17/766,577

(22) PCT Filed: Oct. 19, 2020

(86) PCT No.: PCT/US2020/056263
§ 371 (c)(1),
(2) Date: Apr. 5, 2022

(87) PCT Pub. No.: WO2021/080898
PCT Pub. Date: Apr. 29, 2021

(65) Prior Publication Data

US 2024/0110109 A1 Apr. 4, 2024

Related U.S. Application Data

(60) Provisional application No. 62/925,444, filed on Oct. 24, 2019.

(51) Int. Cl.
*C10G 9/36* (2006.01)

(52) U.S. Cl.
CPC ..... *C10G 9/36* (2013.01); *C10G 2300/1003* (2013.01); *C10G 2300/4006* (2013.01)

(58) Field of Classification Search
CPC .... C10G 9/00; C10G 9/36; C10G 2300/1003; C10G 2300/4006; C10G 1/002
See application file for complete search history.

(56) References Cited

U.S. PATENT DOCUMENTS 3,498,906 A * 3/1970 Bogart ..... C10G 9/002 208/50
3,923,921 A * 12/1975 Kohfeldt ..... C10G 9/002 208/100

(Continued)

FOREIGN PATENT DOCUMENTS

GB 2158089 A 11/1985
WO WO 2001/005908 A1 1/2001

(Continued)

OTHER PUBLICATIONS

Zimmermann H, "Steamcracking—State of the Art", Erdoel Erdgas Kohle, Urban Verlag, Hamburg, DE, vol. 125, No. 12, 01 (Dec. 1, 2009), p. 191-196, XP001549784 ISSN: 0179-3187.

*Primary Examiner* — Youngsul Jeong
*Assistant Examiner* — Jason Y Chong
(74) *Attorney, Agent, or Firm* — C. Tumey Law Group PLLC

(57) ABSTRACT

A method for steam cracking a plastic-derived liquid feedstock can comprise: steam cracking a plastic-derived liquid feedstock in a steam cracker to produce a cracked product, wherein the plastic-derived liquid feedstock has a final boiling point of about 550° C. or less and an olefin content of about 40 wt % or less; quenching the cracked product from a temperature of about 750° C. or greater to a temperature of about 350° C. or less with a quench oil; and wherein the method does not comprise hydrotreating and/or fractionating the plastic-derived liquid feedstock before steam cracking.

20 Claims, 1 Drawing Sheet

(56) References Cited

U.S. PATENT DOCUMENTS

| | | | | |
|---|---|---|---|---|
| 4,121,908 | A | 10/1978 | Raab et al. | |
| 4,444,697 | A | 4/1984 | Gater et al. | |
| 5,731,483 | A | 3/1998 | Stabel et al. | |
| 9,920,255 | B2 | 3/2018 | Hofer | |
| 10,131,847 | B2 | 11/2018 | McNamara et al. | |
| 2003/0199718 | A1 | 10/2003 | Miller | |
| 2004/0004022 | A1* | 1/2004 | Stell | C10G 9/36 208/132 |
| 2016/0362609 | A1 | 12/2016 | Ward et al. | |
| 2018/0320088 | A1* | 11/2018 | Spicer | B01J 19/2415 |
| 2020/0017772 | A1 | 1/2020 | Ramamurthy et al. | |
| 2020/0369966 | A1* | 11/2020 | Bitting | C10G 9/20 |

FOREIGN PATENT DOCUMENTS

| | | | |
|---|---|---|---|
| WO | WO 2018/055555 | A1 | 3/2018 |
| WO | WO 2018/069794 | A1 | 4/2018 |

* cited by examiner

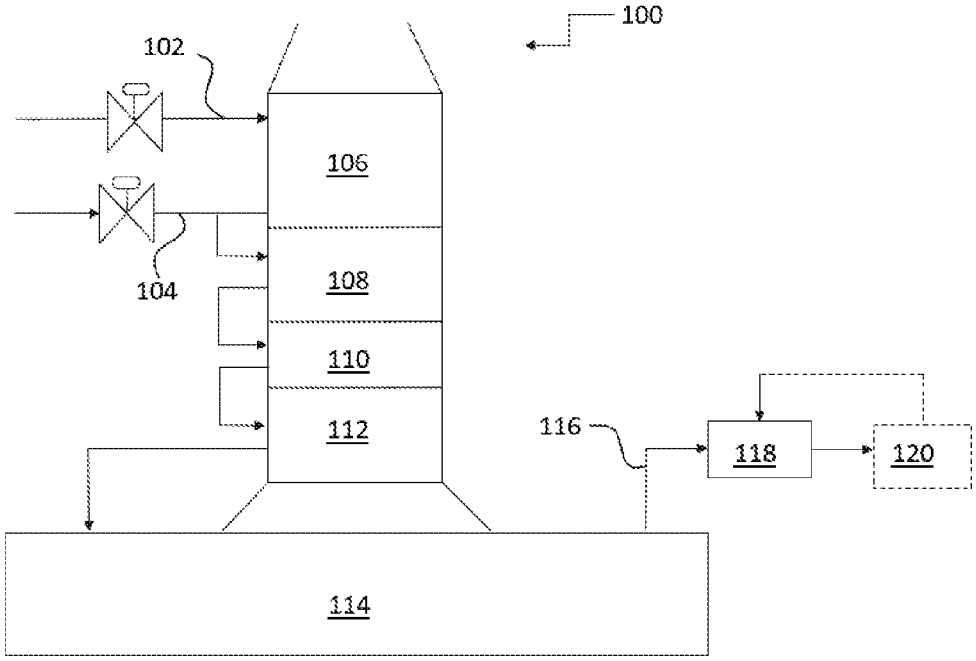
100
102
104
106
108
110
112
114
116
118
120

DIRECT STEAM CRACKING METHODS FOR LIQUIDS PRODUCED FROM PLASTIC WASTE

CROSS-REFERENCE TO RELATED APPLICATIONS

This application is a National Phase application claiming priority to PCT application Serial No. PCT/US2020/056263, filed Oct. 19, 2020, which claims the priority benefit of U.S. Ser. No. 62/925,444, filed Oct. 24, 2019, which are incorporated by reference in their entirety.

FIELD

The present disclosure relates to methods for steam cracking a plastic-derived feedstock.

BACKGROUND

The rate of plastics production has steadily increased in the past century to a global value of about 400 million tons (MT) in 2016. This rapid increase in plastic products, especially for short life applications such as single-use plastic containers, has created significant challenges for sustainable plastic waste management. Several waste valorization methods have been proposed over the years ranging from direct recycling to energy generation from plastic waste.

For example, U.S. Pat. No. 10,131,847 describes in part a process for the conversion of waste hydrocarbon material such as plastics into fuels. GB 2158089 describes in part a treatment process in which plastics are melted and heated to produce gas, the gas is then condensed to provide an oily liquid, and the liquid is fractionally distilled.

In additional examples, catalysts may be used for treating plastic-derived feedstock. US Pat. Pub. No. 2003/0199718 describes an approach in which there is pyrolysis and the reactor is maintained at a temperature in the range of 450° C. and 700° C. The effluent from the pyrolysis reactor is passed to a catalytic summarization de-waxing unit. WO 2001/005908 describes a process in which there are first and second cracking stages with first and second catalysts.

In yet another example, WO 2018/069794 and WO 2018/055555 describe processes for recovering gas and liquids from plastic waste pyrolysis and hydrotreating the liquid products before steam cracking to produce olefins. Said processes restrict the liquid feedstock for the steam cracker to having a boiling point less than 370° C. due to coking issues with plastic-derived feedstocks, which is why the hydrotreating step is required.

Each of the foregoing examples include several steps and, in some instances, catalysts to convert plastic-derived feedstock to a valuable product. Each of these steps and catalysts can require significant capital expenditures for implementation.

SUMMARY OF THE INVENTION

The present disclosure relates to methods for the direct steam cracking of a plastic-derived liquid feedstock.

The present disclosure includes a method comprising: steam cracking a plastic-derived liquid feedstock in a steam cracker to produce a cracked product, wherein the plastic-derived liquid feedstock has a final boiling point of about 550° C. or less and an olefin content of about 40 wt % or less; quenching the cracked product from a temperature of about 750° C. or greater to a temperature of about 350° C. or less with a quench oil; and wherein the method does not comprise hydrotreating the plastic-derived liquid feedstock before steam cracking.

The present disclosure also includes a method comprising: steam cracking a plastic-derived liquid feedstock in a steam cracker to produce a cracked product, wherein the plastic-derived liquid feedstock has a final boiling point of about 550° C. or less and an olefin content of about 40 wt % or less; quenching the cracked product from a temperature of about 750° C. or greater to a temperature of about 350° C. or less with a quench oil; and wherein the method does not comprise fractionating the plastic-derived liquid feedstock before steam cracking.

The present disclosure also includes a method comprising: steam cracking a plastic-derived liquid feedstock in a steam cracker to produce a cracked product, wherein the plastic-derived liquid feedstock has a final boiling point of about 550° C. or less and an olefin content of about 40 wt % or less; quenching the cracked product from a temperature of about 750° C. or greater to a temperature of about 350° C. or less with a quench oil; and wherein the method does not comprise hydrotreating and fractionating the plastic-derived liquid feedstock before steam cracking.

BRIEF DESCRIPTION OF THE DRAWINGS

The following FIGURE is included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

The FIGURE illustrates a method of directly steam cracking the plastic-derived liquid feedstock of the present disclosure as well as a nonlimiting example of a suitable steam cracking furnace according to the disclosure herein.

DETAILED DESCRIPTION

The present disclosure relates to methods for the direct steam cracking of liquids produced from plastic waste pyrolysis. Even more particularly, this disclosure presents methods for processing plastic-derived liquid feedstock, including the liquid portion of the feedstock, produced from plastic waste pyrolysis directly in a steam cracking furnace without fractionation of the heavy-end or hydrogenation of the plastic-derived liquid feedstock.

Further, the systems and methods described herein use direct quench oil injection to prevent the fouling that is normally associated with plastic waste streams.

Of the many benefits presented by this disclosure, one benefit is that the plastic-derived liquid feedstock can be directly processed in the steam cracking process without having to further process the feedstock before steam cracking. Accordingly, capital expenses related to processes that can precede the steam cracking process can be avoided.

Definitions

An "olefin," as that term is used herein, alternatively referred to as "alkene," is a linear, branched, or cyclic compound of carbon and hydrogen having at least one double bond.

The boiling range covers a temperature interval from the initial boiling point (IBP), defined as the temperature at which the first drop of distillation product is obtained, to a final boiling point, or end point (EP) when the highest-boiling compounds evaporate. The term "final boiling point" as used herein refers to the temperature at which the highest-boiling compounds evaporate.

The term "directly into a cracking furnace" refers to supplying a plastic-derived liquid feedstock to a cracking furnace without intermediate processing (e.g., hydrotreating and/or fractionation) between production of the plastic-derived liquid feedstock and introduction to the cracking furnace. Directly does not imply a direct fluid connection between the two systems. That is, the plastic-derived liquid feedstock can be produced at one site and transported to another for cracking. The plastic-derived liquid feedstock preferably does not contain significant amounts of $C_1$ to $C_4$ hydrocarbons. Thus, it should be understood that the plastic-derived liquid feedstock may have been previously subjected to a separation process whereby gaseous hydrocarbons are flash separated from the resulting plastic-derived liquid feedstock.

Methods

The plastic-derived liquid feedstocks used in the methods and systems of the present disclosure are produced from plastic waste. For example, suitable processes for producing plastic-derived liquid feedstocks described herein are included in U.S. Pat. No. 10,131,847, the disclosure of which is incorporated herein by reference. In the described processes, waste plastic material may be processed to granular or flake form that is heated in an extruder to produce molten plastics (e.g., at 300° C. to 320° C.). The molten plastics can then be heated in pyrolysis chambers. In each pyrolysis chamber, the plastic materials may be heated to 390° C. to 410° C. in a nitrogen purged system while agitating the mixture (e.g., with a central auger or screw). Pyrolysis gases are produced and captured, which causes some condensation of the vapor long carbon chains. The condensed gases can be fed back to the pyrolysis chamber to be thermally degraded. Additional thermal degradation is achieved by allowing the pyrolysis gases to rise and the heavier chains to condense and be run back for further pyrolysis.

Other methods may be used for producing suitable plastic-derived liquid feedstocks of the present disclosure.

The plastic-derived liquid feedstocks described herein have a final boiling point of about 550° C. or less (e.g., about 450° C. to about 550° C., or about 450° C. to about 500° C., or about 500° C. to about 550° C.) and an olefin content of about 40 wt % or less (e.g., about 0.1 wt % to 40 wt %, or 0.1 wt % to about 10 wt %, or about 10 wt % to about 20 wt %, or about 20 wt % to about 30 wt %, or about 30 wt % to about 40 wt %). These parameters are in contrast with other methods where the plastic-derived liquid feedstock before introduction to the steam cracker should have a final boiling point of 370° C. or less.

The plastic-derived liquid feedstocks described herein are directly steam cracked. Steam cracking is a technology that has been used to thermally crack various hydrocarbon feedstocks into light olefins such as ethylene and propylene. Conventional steam cracking utilizes a pyrolysis furnace that has two main sections: a convection section and a radiant (or "pyrolysis") section. The hydrocarbon feedstock typically enters the convection section of the furnace as a liquid (except for the light feedstocks which enter as a vapor) where it is heated and vaporized by indirect contact with hot flue gas from the radiant section and by direct contact with the steam. The vaporized hydrocarbon and steam mixture is then introduced into the radiant section where thermal cracking takes place. The resulting products, including olefins, leave the pyrolysis furnace and are quenched and further processed downstream into desirable end products. It can be essential to cool the effluent gas rapidly to avoid further reactions, which reduce selectively to the desired olefins. Cooling is usually carried out in a quench point or quench pipe receiving the effluent gas.

The FIGURE illustrates a method of directly steam cracking the plastic-derived liquid feedstock of the present disclosure as well as a nonlimiting example of a suitable steam cracking furnace according to the disclosure herein.

As used herein, when describing components of a system that are fluidly coupled, the fluid coupling refers to fluids being able to travel from one component to the other or between components. When traversing a fluid coupling, the fluid may travel through hardware like lines, pipes, pumps, connectors, heat exchangers, and valves that ensure proper operation and safety measures when operating the system. As used herein, when describing components and/or lines being configured for delivery, configured for receiving, or configured for conveying (or grammatical variations thereof), this provides a fluid flow direction and can include other components (if needed like pumps) or use pressure differences to effect the flow of the fluid.

The steam cracking furnace 100 includes a plurality of convection sections 106, 108, 110, and 112 and a radiant or pyrolysis section 114. A series of tubes (not shown) traverse these various sections. Flue gas from the pyrolysis section 114 travels upward through the convection sections 106, 108, 110, and 112 to heat the tubes, and contents thereof, passing through of the convection sections 106, 108, 110, and 112 via heat exchange processes.

A line 102 supplies the plastic-derived liquid feedstock to the uppermost convection section 106 to be preheated by the flue gas from pyrolysis section 114 to a temperature of about 160° C. to about 230° C.

Notably the plastic-derived liquid feedstock need not be processed (e.g., through a hydrogenation step) before providing the plastic-derived liquid feedstock to convection section 106 for processing in the steam cracking furnace. In other words, according to the methods of the present disclosure, the plastic-derived liquid feedstock can fed directly into the steam cracking furnace.

The plastic-derived liquid feedstock is diluted with steam, which is entrained with the plastic-derived liquid feedstock between convection sections 106 and 108 using line 104, to produce a diluted plastic-derived liquid feedstock. The weight ratio of steam to plastic-derived liquid feedstock can be about 0.1:1 to about 1:1 (e.g., about 0.1:1 to about 0.5:1, or about 0.25:1 to about 0.75:1, or about 0.5:1 to about 1:1).

The diluted plastic-derived liquid feedstock sequentially passes through the convection sections 108, 110, and 112 to be further heated by the flue gas. When the diluted plastic-derived liquid feedstock reaches the pyrolysis section 114, the diluted plastic-derived liquid feedstock is a vapor.

In pyrolysis section 114, the diluted plastic-derived liquid feedstock is cracked at temperatures of up to about 900° C. (e.g., about 400° C. to about 900° C., about 700° C. to about 900° C., about 750° C. to about 850° C.), a pressure of about 0.1 bar absolute (bara) to about 5 bara (e.g., about 1 bara to about 5 bara, or about 2 bara to about 4 bara), and a residence time of about 0.1 seconds to about 2.0 seconds (e.g., about 0.5 seconds to about 1.0 seconds, or about 1.0 second to about 2.0 seconds).

To avoid continued reaction and mitigate fouling (e.g., coking) from the cracking process, the cracked product is cooled down by direct quench oil injection upon leaving the pyrolysis section 114. More specifically, the outlet stream from pyrolysis section 114 is supplied via line 116 to a direct quenching unit 118 a quench oil used to cool the cracked product via heat exchange. The quench oil can be a heavy hydrocarbon, such as a $C_{10}$ to $C_{15}$ hydrocarbon. Suitable quenching examples are disclosed in U.S. Pat. No. 4,444,697, the disclosure of which is herein incorporated by reference.

The direct quenching process allows for use of the plastic-derived liquid feedstock described herein having a higher final boiling point without the need for hydrogenation of the plastic-derived liquid feedstock before steam cracking.

In some instances, swirl-type, tangential injection may be used to ensure good distribution of a portion of the quenching oil around and along the inside surface of the quenching unit. Centrifugal force keeps the liquid on the wall and allows this quench configuration to be used in any orientation with respect to horizontal. A very substantial portion of the liquid is sheared off by the gas and enters the gas stream where it cools the gas by transfer of sensible heat and, if volatile, also by evaporation.

The ratio of the quench oil to gas flow depends on the initial temperatures of the two streams and the desired mix temperature. Typically the weight ratio of flow rate of quench oil to flow rate of gas is in the range of about 2 to about 5, usually about 2.5 to about 4.0 when the quench oil is one that vaporizes readily under the conditions used, for example a gas oil fraction. However, with decreasing volatility of the quench oil, the ratio may range above 5 and when a high-boiling or bottoms oil fraction which vaporizes only slightly under the conditions is used as quench, this ratio can be as high as about 15:1. Thus the ratio will be selected from a range of about 2 to about 15 depending on how heavy the quench oil is.

Preferably above 50% to about 90% (e.g., about 80%) of the quench oil becomes physically entrained in the cracked gas stream and into the cracked gas where good mixing, heat transfer and (in the case of a volatile liquid) evaporation of the injected liquid ensues with quenching of the gas stream.

The temperature of the quench oil may be about 325° C. or less (e.g., about 150° C. to about 325° C., or about 150° C. to about 275° C., or about 200° C. to about 250° C.). The temperature of the cracked product before quenching may be about 750° C. or greater (e.g., about 750° C. to about 925° C., or about 750° C. to about 850° C., or about 850° C. to about 925° C.) and after quenching may be about 350° C. or less (e.g., about 225° C. to about 350° C., or about 225° C. to about 275° C., or about 275° C. to about 350° C.).

The cracked product after direct quenching can be sent to a fractionation unit 120. Optionally, a cut from the fractionation process can be recycled to the direct quenching unit 118. The fractionation unit 120 can produce any number of cuts. Examples of cuts include, but are not limited to, an overheads cut (preferably boiling point of less than about 220° C.), a diesel cut (preferably boiling point of about 220° C. to about 370° C.), a light vacuum gas oil cut (preferably boiling point of about 370° C. to about 480° C.), and an atmospheric bottoms cut (boiling point of about 480+° C.). Other cuts can be collected depending on the configuration and operational parameters of the fractionation unit 120.

Example Embodiments

A first nonlimiting example embodiment of the present disclosure is a method comprising: steam cracking a plastic-derived liquid feedstock in a steam cracker to produce a cracked product, wherein the plastic-derived liquid feedstock has a final boiling point of about 550° C. or less and an olefin content of about 40 wt % or less; quenching the cracked product from a temperature of about 750° C. or greater to a temperature of about 350° C. or less with a quench oil; and wherein the method does not comprise hydrotreating the plastic-derived liquid feedstock before steam cracking. The first nonlimiting example embodiment may include one or more of the following: Element 1: wherein the method does not comprise fractionating the plastic-derived liquid feedstock before steam cracking; Element 2: the method further comprising: fractionating the cracked product after quenching into a plurality of cuts; Element 3: Element 2 and wherein the plurality of cuts comprise one or more cuts selected from the group consisting of: an overheads cut, a diesel cut, a light vacuum gas oil cut, and an atmospheric bottoms cut; Element 4: Element 2 and recycling one or more of the plurality of cuts back as at least a portion of the quench oil; Element 5: wherein the quench oil comprises a $C_{10}$ to $C_{15}$ hydrocarbon; Element 6: wherein the plastic-derived liquid feedstock has a final boiling point of about 450° C. to about 550° C. and an olefin content of about 0.1 wt % to about 40 wt %; Element 7: wherein the quench oil is at a temperature of about 325° C. or less; Element 8: wherein the quench oil is at a temperature of about 150° C. to about 325° C.; Element 9: wherein in quenching the cracked product drops from the temperature of about 750° C. to about 925° C. to the temperature of about 225° C. to about 350° C.; Element 10: wherein steam cracking comprises: introducing the plastic-derived liquid feedstock into the steam cracker; heating the plastic-derived liquid feedstock in a first convection section of the steam cracker; entraining steam with the plastic-derived liquid feedstock to produce a diluted plastic-derived liquid feedstock; heating the diluted plastic-derived liquid feedstock in a second convection section of the steam cracker; and cracking the diluted plastic-derived liquid feedstock in the pyrolysis section of the steam cracker; Element 11: Element 10 and wherein the plastic-derived liquid feedstock is heated to a temperature of about 160° C. to about 230° C. in the first convection section of the steam cracker; Element 12: Element 10 and wherein the diluted plastic-derived liquid feedstock is a vapor before cracking; and Element 13; Element 10 and wherein cracking is performed at a temperature of about 400° C. to about 900° C., a pressure of about 0.1 bar absolute (bara) to about 5 bara, and a residence time in the pyrolysis section of about 0.1 seconds to about 2.0 seconds. Examples of combinations include, but are not limited to, Element 1 in combination with one or more of Elements 2 and 13; Element 2 in combination with Elements 3 and 4; Element 2 (optionally in combination with one or both of Elements 3 and 4) in combination with one or more of Elements 5-13; Element 5 in combination with Element 7 and/or Element 8; Element 6 in combination with one or more of Elements 7-13; Elements 5 and 6 in combination and optionally in further combination with one or more of Elements 7-13; Element 8 and/or Element 9 in combination with one or more of Elements 10-13; and Element 10 in combination with one or more of Elements 11-13.

A second nonlimiting example embodiment of the present disclosure is a method comprising: steam cracking a plastic-derived liquid feedstock in a steam cracker to produce a cracked product, wherein the plastic-derived liquid feedstock has a final boiling point of about 550° C. or less and an olefin content of about 40 wt % or less; quenching the cracked product from a temperature of about 750° C. or greater to a temperature of about 350° C. or less with a quench oil; and wherein the method does not comprise fractionating the plastic-derived liquid feedstock before steam cracking. The first nonlimiting example embodiment may include one or more of the following: Element 2; Element 3; Element 4; Element 5; Element 6; Element 7; Element 8; Element 9; Element 10; Element 11; Element 12; and Element 13. Examples of combinations include, but are not limited to, Element 2 in combination with Elements 3 and 4; Element 2 (optionally in combination with one or both of Elements 3 and 4) in combination with one or more of Elements 5-13; Element 5 in combination with Element 7 and/or Element 8; Element 6 in combination with one or more of Elements 7-13; Elements 5 and 6 in combination and optionally in further combination with one or more of Elements 7-13; Element 8 and/or Element 9 in combination with one or more of Elements 10-13; and Element 10 in combination with one or more of Elements 11-13.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

The invention claimed is:

1. A method comprising:

heating a plastic material to 300° C. to 320° C. to form molten plastics;

heating the molten plastics in a pyrolysis chamber to 390° C. to 410° C. in a nitrogen purged system while agitating the molten plastics to form a plastic derived liquid feedstock;

flash separating $C_1$ to $C_4$ hydrocarbons from the plastic-derived liquid feedstock;

directly supplying the plastic-derived liquid feedstock from the flash separating to a cracking furnace without any other intermediate processing including hydrotreating and fractionation;

heating the plastic-derived liquid feedstock by a flue gas in a first convection section of the cracking furnace to a temperature from 160° C. to 230° C., wherein the first convection section comprises an uppermost convection section of the cracking furnace;

diluting the plastic-derived liquid feedstock with steam between the first convection section and a second convection of the cracking furnace to give a diluted plastic-derived liquid feedstock;

passing the diluted plastic-derived feedstock sequentially through the second convection, a third convection section of the cracking furnace, and a fourth convection section of the cracking furnace, thereby heating by the flue gas the diluted plastic-derived liquid feedstock in the second convection section, the third convection section, and the fourth convection section;

steam cracking the diluted plastic-derived liquid feedstock in a steam cracker comprising the cracking furnace to produce a cracked product, wherein the plastic-derived liquid feedstock supplied to the first convection section has a final boiling point of about 500° C. to about 550° C. and an olefin content of about 40 wt % or less;

quenching the cracked product from a temperature of about 750° C. or greater to a temperature of about 350° C. or less by tangential injection or swirl-type injection of a quench oil comprising $C_{10}$ to $C_{15}$ hydrocarbon around and along an inside surface of a quenching unit, wherein a weight ratio of flow rate of quench oil to flow rate of cracked product is in a range of about 2 to about 15; and wherein the method does not comprise hydrotreating the plastic-derived liquid feedstock before the steam cracking.

2. The method of claim 1, wherein the method does not comprise fractionating the plastic-derived liquid feedstock from the flash separating before the steam cracking.

3. The method of claim 1, further comprising:
fractionating the cracked product after quenching into a plurality of cuts.

4. The method of claim 3, wherein the plurality of cuts comprise one or more cuts selected from the group consisting of: an overheads cut, a diesel cut, a light vacuum gas oil cut, and an atmospheric bottoms cut.

5. The method of claim 3 further comprising:
recycling one or more of the plurality of cuts back as at least a portion of the quench oil.

6. The method of claim 1, wherein the plastic-derived liquid feedstock supplied to the cracking furnace has an olefin content of about 0.1 wt % to about 40 wt %.

7. The method of claim 1, wherein the quench oil is at a temperature of about 325° C. or less.

8. The method of claim 1, wherein the quench oil is at a temperature of about 150° C. to about 325° C.

9. The method of claim 1, wherein in quenching the cracked product drops from the temperature of about 750° C. to about 925° C. to the temperature of about 225° C. to about 350° C.

10. The method of claim 1, wherein the steam cracking comprises steam cracking the diluted plastic-derived liquid feedstock in a pyrolysis section of the steam cracker.

11. The method of claim 10, wherein the flue gas flows from the pyrolysis section upward through the fourth convection section, the third convection section, the second convection section, and the first convection section.

12. The method of claim 10, wherein the diluted plastic-derived liquid feedstock is a vapor before the steam cracking.

13. The method of claim 10, wherein cracking is performed at a temperature of about 400° C. to about 900° C., a pressure of about 0.1 bar absolute (bara) to about 5 bara, and a residence time in the pyrolysis section of about 0.1 seconds to about 2.0 seconds.

14. A method comprising:
producing a plastic-derived liquid feedstock from plastic material by heating the plastic material to 300° C. to 320° C. to form molten plastics without any feedstock pretreatment;
heating the molten plastics in a pyrolysis chamber to 390° C. to 410° C. in a nitrogen purged system while agitating the molten plastics to form the plastic derived liquid feedstock;
flash separating $C_1$ to $C_4$ hydrocarbons from the plastic-derived liquid feedstock;
directly supplying the plastic-derived liquid feedstock from the flash separating to a cracking furnace without any other intermediate processing including hydrotreating and fractionation;
heating the plastic-derived liquid feedstock by a flue gas in a first convection section of the cracking furnace to a temperature from 160° C. to 230° C., wherein the first convection section comprises an uppermost convection section of the cracking furnace;
diluting the plastic-derived liquid feedstock with steam between the first convection section and a second convection of the cracking furnace to give a diluted plastic-derived liquid feedstock;
passing the diluted plastic-derived feedstock sequentially through the second convection, a third convection section of the cracking furnace, and a fourth convection section of the cracking furnace, thereby heating by the flue gas the diluted plastic-derived liquid feedstock in the second convection section, the third convection section, and the fourth convection section;
steam cracking the diluted plastic-derived liquid feedstock in a steam cracker comprising the cracking furnace to produce a cracked product, wherein the plastic-derived liquid feedstock supplied to the first convection section has a final boiling point of about 500° C. to about 550° C. and an olefin content of about 40 wt % or less;
quenching the cracked product from a temperature of about 750° C. or greater to a temperature of about 350° C. or less with a quench oil; and
wherein the method does not comprise fractionating the plastic-derived liquid feedstock from the flash separating before the steam cracking.

15. The method of claim 14, further comprising:
fractionating the cracked product after quenching into a plurality of cuts.

16. The method of claim 14, wherein the plastic-derived liquid feedstock supplied to the first convection section has an olefin content of about 0.1 wt % to about 40 wt %.

17. The method of claim 14, wherein the quench oil is at a temperature of about 325° C. or less.

18. The method of claim 14, wherein the quench oil is at a temperature of about 150° C. to about 325° C.

19. The method of claim 14, wherein in quenching the cracked product drops from the temperature of about 750° C. to about 925° C. to the temperature of about 225° C. to about 350° C.

20. A method comprising:
producing a plastic-derived liquid feedstock from plastic material by heating the plastic material to 300° C. to 320° C. to form molten plastics;
heating the molten plastics in a pyrolysis chamber to 390° C. to 410° C. in a nitrogen purged system while agitating the molten plastics to form a plastic derived liquid feedstock;
flash separating $C_1$ to $C_4$ hydrocarbons from the plastic-derived liquid feedstock;
directly supplying a plastic-derived liquid molten plastic feedstock from the flash separating to a cracking furnace without any other intermediate processing including hydrotreating and fractionation;
heating the plastic-derived liquid feedstock by a flue gas in a first convection section of the cracking furnace to a temperature from 160° C. to 230° C., wherein the first convection section comprises an uppermost convection section of the cracking furnace;
diluting the plastic-derived liquid feedstock with steam between the first convection section and a second convection of the cracking furnace to give a diluted plastic-derived liquid feedstock;
passing the diluted plastic-derived feedstock sequentially through the second convection, a third convection section of the cracking furnace, and a fourth convection section of the cracking furnace, thereby heating by the flue gas the diluted plastic-derived liquid feedstock in the second convection section, the third convection section, and the fourth convection section;
steam cracking the diluted plastic-derived liquid feedstock in a steam cracker comprising the cracking furnace to produce a cracked product, wherein the steam cracking has a weight ratio of steam to the diluted plastic-derived liquid feedstock is from 0.25:1 to about 0.75:1; wherein the plastic-derived liquid feedstock supplied to the first convection section has a final boiling point of about 500° C. to about 550° C. and an olefin content of about 40 wt % or less;

quenching the cracked product from a temperature of about 750° C. or greater to a temperature of about 350° C. or less by tangential injection or swirl-type injection of a quench oil comprising $C_{10}$ to $C_{15}$ hydrocarbon around and along an inside surface of a quenching unit, wherein a weight ratio of flow rate of quench oil to flow rate of cracked product is in a range of about 2 to about 15; and wherein the method does not comprise hydrotreating the plastic-derived liquid feedstock before the steam cracking.

* * * * *